US011302502B2

(12) United States Patent
Cassina et al.

(10) Patent No.: US 11,302,502 B2
(45) Date of Patent: Apr. 12, 2022

(54) TERMINAL CLAMP COVER DEVICE FOR LOW VOLTAGE CIRCUIT BREAKERS

(71) Applicant: ABB S.p.A., Milan (IT)

(72) Inventors: Stefano Cassina, Albano Sant'Alessandro (IT); Alessandro Adami, Bergamo (IT)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 16/983,297

(22) Filed: Aug. 3, 2020

(65) Prior Publication Data

US 2021/0035761 A1 Feb. 4, 2021

(30) Foreign Application Priority Data

Aug. 2, 2019 (IT) ..... 202019000002703

(51) Int. Cl.
*H01H 71/08* (2006.01)
*H01H 71/02* (2006.01)
(Continued)

(52) U.S. Cl.
CPC ..... *H01H 71/08* (2013.01); *H01H 9/0264* (2013.01); *H01H 9/52* (2013.01); *H01H 71/0207* (2013.01); *H01R 4/48* (2013.01)

(58) Field of Classification Search
CPC ..... H01H 71/08; H01H 9/0264; H01H 9/52; H01H 71/0207; H01H 9/342; H01H 4/38;
(Continued)

(56) References Cited

U.S. PATENT DOCUMENTS 5,717,182 A * 2/1998 Mina ..... H01H 1/2016 218/12
6,323,748 B1 * 11/2001 Malingowski ..... H01H 3/04 335/172
(Continued)

FOREIGN PATENT DOCUMENTS

CN 201758107 U 3/2011
EP 2645486 A1 10/2013
(Continued)

OTHER PUBLICATIONS

U.K. Patent Office, Examination Report issued in corresponding Application No. GB2008984.3, dated Dec. 3, 2020, 5 pp.
(Continued)

*Primary Examiner* — Edwin A. Leon
(74) *Attorney, Agent, or Firm* — Greenberg Traurig, LLP

(57) ABSTRACT

A terminal clamp cover device for low voltage circuit breakers, in particular for molded case circuit breakers, having one or more phases, each provided with a terminal for the electrical connection of the circuit breaker, a clamp for the connection of the terminal to an electrical circuit and a vent opening to discharge the gases produced in the circuit breaker during opening/closing operations. The device includes an insulating body that covers the clamp, the insulating body being provided on at least one portion of its outer surface with a plurality of heat dissipating elements. A low voltage circuit breaker, in particular a low voltage molded case circuit breaker, including a device of the type described also forms part of the application.

19 Claims, 5 Drawing Sheets

(51) Int. Cl.
*H01H 9/02* (2006.01)
*H01R 4/48* (2006.01)
*H01H 9/52* (2006.01)

(58) Field of Classification Search
CPC ..... H01H 71/082; H01H 71/1045; H01H 2011/0037; H01R 4/48; H01R 9/2675
USPC ..... 200/293
See application file for complete search history.

(56) References Cited

U.S. PATENT DOCUMENTS

| | | | | |
|---|---|---|---|---|
| 7,009,348 | B2 | 3/2006 | Mogilner et al. | |
| 9,385,355 | B2 * | 7/2016 | Pinon ..... | H01M 10/4257 |
| 9,947,496 | B2 | 4/2018 | Niehoff | |

FOREIGN PATENT DOCUMENTS

| | | | |
|---|---|---|---|
| EP | 2645487 | A1 | 10/2013 |
| KR | 1020160117062 | A | 10/2016 |
| KR | 2020170123091 | A | 11/2017 |

OTHER PUBLICATIONS

Indian Patent Office, Examination Report issued in corresponding Application No. 202044032427, dated Mar. 12, 2021, 5 pp.

* cited by examiner

TERMINAL CLAMP COVER DEVICE FOR LOW VOLTAGE CIRCUIT BREAKERS

The present model relates to a terminal clamp cover device for low voltage circuit breakers, in particular for low voltage molded case circuit breakers, of innovative type with improved features in terms of heat dissipation capacity, practicality of use and ease of production.

As is known, low voltage circuit breakers, and in particular for low voltage molded case circuit breakers, generally comprise an enclosure and a plurality of electrical poles, associated with each of which is at least one pair of contacts, which can be in contact with and separated from one another. Circuit breakers of the state of the art also comprise control means that cause the relative movement of said pairs of contacts so that they can take at least one first position, in contact (circuit closed), and a second position, separated (circuit open).

During the useful life of a low voltage circuit breaker, phenomena that expose the circuit breaker and the network to particularly heavy stresses can take place. This occurs firstly when the circuit breaker is required to withstand, even for short periods, currents exceeding the rated values. Therefore, in general, in low voltage automatic circuit breakers, the critical function of interrupting the current (whether this is rated, overload or short-circuit current) is managed in a specific portion of the circuit breaker that consists of the chamber that deionizes the arc, or "arc chamber".

Therefore, generally at least one arc chamber, i.e., a region of space that is particularly suitable to facilitate interruption of the electric arc, is associated with each pole of the circuit breaker. Arc chambers can simply be regions provided in the casing of the circuit breaker, or can comprise various shaped modular elements, such as enclosures made of insulating material provided with anti-arcing plates. Modular arc chambers, which are more advanced, have the advantage of being easily replaceable; moreover, they can also be made using materials that are more suitable, for example, to those used for the enclosure of the circuit breaker.

In operating conditions, following the opening movement, the voltage across the contacts causes dielectric discharge of the air, leading to the formation of the electric arc in the chamber. The arc is moved by electromagnetic and fluid-dynamic forces inside a series of metal arc extinguishing plates arranged in the chamber, the purpose of which is to extinguish said arc by cooling and splitting actions.

During the formation of the arc, the energy released through the Joule effect is very high and causes thermal and mechanical stresses in the region containing the plate. It is worthwhile noting that, depending on the type of circuit breaker and the arc phenomenon that occurs, the pressure in the contact zone, and in particular in the arc chamber, can reach very high values, for example up to 30-40 bar, while the temperature of the ionized gases can reach values of 15000-20000 K.

Therefore, the arc chamber must be provided with suitable discharge zones and cooling means of the hot gases that develop during arcing. For this purpose, low voltage circuit breakers are generally provided with openings for the discharge of hot gases produced during arcing and with a filtering system, which also cools the gases, reduces the discharge flow rate, and limits flame or plasma emission.

However, depending on the application and on the type of operations, the temperatures that are reached in the vicinity of the gas discharge zones are in any case very high and can create a plurality of problems for the circuit breaker, in particular in the zones in which the clamps that connect the circuit breaker to the circuit in which it is inserted are positioned, where adequate segregation between the various phases and between the phases and the door of the panel in which the circuit breaker is inserted must be guaranteed.

It would thus be desirable to have low voltage circuit breakers that overcome these problems and prevent these drawbacks.

Therefore, the present utility model relates to a terminal clamp cover device for low voltage circuit breakers, in particular for molded case circuit breakers, said circuit breaker having one or more phases each provided with a terminal for the electrical connection of said circuit breaker, a clamp for the connection of said terminal to an electrical circuit and a vent opening to discharge the gases produced in said circuit breaker during opening/closing operations. The device according to the present model is characterized by comprising an insulating body that covers said clamp, said insulating body having on at least one portion of its outer surface a plurality of heat dissipating elements.

In a further aspect, the present model also relates to a low voltage circuit breaker, in particular a low voltage molded case circuit breaker, comprising one or more phases each provided with a terminal for the electrical connection of said circuit breaker, a clamp for connection of said terminal to an electrical circuit and a vent opening to discharge the gases produced in said circuit breaker during opening/closing operations, which comprises a terminal clamp cover device as described herein.

In practice, the device of the present invention effectively contributes to the dissipation of heat in the zones of the circuit breaker in which the clamps are located, contiguously to the openings for venting gases from the arc chamber of each pole of the circuit breaker.

For the purposes of the present model, in the description the terms "vertical", "horizontal", "front", "rear", "lateral", "upper" and "lower" refer to the typical operating configuration of the circuit breaker.

As better described below, in a preferred embodiment of a terminal clamp cover device for low voltage circuit breakers according to the present invention, the clamp is substantially L-shaped. The insulating body is also substantially L-shaped and has a first and a second substantially continuous and substantially L-shaped lateral surface, with the plurality of heat dissipating elements which are conveniently positioned on at least one portion of said first and second lateral surface.

Advantageously, said plurality of heat dissipating elements comprises a plurality of parallel fins that are arranged along at least one portion of each of said first and second lateral surface. Preferably, at least one part of said fins extends along the whole length of each of said first and second lateral surface, so as to involve the parts of the dissipation elements closest to the zones in which heat is produced.

In particular, according to an advantageous embodiment of the terminal clamp cover device for low voltage circuit breakers of the present invention, said parallel fins are positioned with a trend parallel to the outflow of heat from the circuit breaker in the upper portion of each of said first and second lateral surface.

According to an alternative embodiment, said parallel fins are positioned substantially on the whole surface of each of said first and second lateral surface, with a trend oriented in the direction of outflow of the gases.

Preferably, at least one part of said parallel fins is adapted to be positioned in proximity of said vent opening of said circuit breaker. In practice, in this configuration the gases exiting from the arc chamber immediately come into contact with the fins, which contribute to their cooling and oblige the gases to follow a path toward the outside of the circuit breaker.

In a greatly preferred embodiment of the terminal clamp cover device for low voltage circuit breakers of the present model, at least one portion of said plurality of heat dissipating elements is made of plastic material.

Moreover, in a further preferred embodiment of the terminal clamp cover device of the present invention, at least one portion of said plurality of heat dissipating elements is made of thermally conductive material.

Advantageously, said insulating body has a rear surface and a lower surface provided with openings that allow the passage of said clamp. In this way, the first insulating body is easily insertable by sliding on said clamp, making assembly of the clamp/terminal clamp cover extremely quick and easy.

Moreover, said insulating body preferably has an upper surface and a front surface provided with access openings to said clamp for fastening it to said terminal of said circuit breaker and to electrical connection means to said electrical circuit.

Further features and advantages of the present model will be more apparent from the description of some embodiments of a terminal clamp cover device for low voltage circuit breakers, in particular for molded case circuit breakers, which are illustrated by way of non-limiting example in the accompanying figures, wherein:

FIG. 1 represents a perspective view of an embodiment of a molded case circuit breaker of conventional type;

FIGS. 2*a*-2*b* represent a perspective view of an embodiment of a terminal clamp cover device for low voltage circuit breakers, according to the present model;

Figure 1:
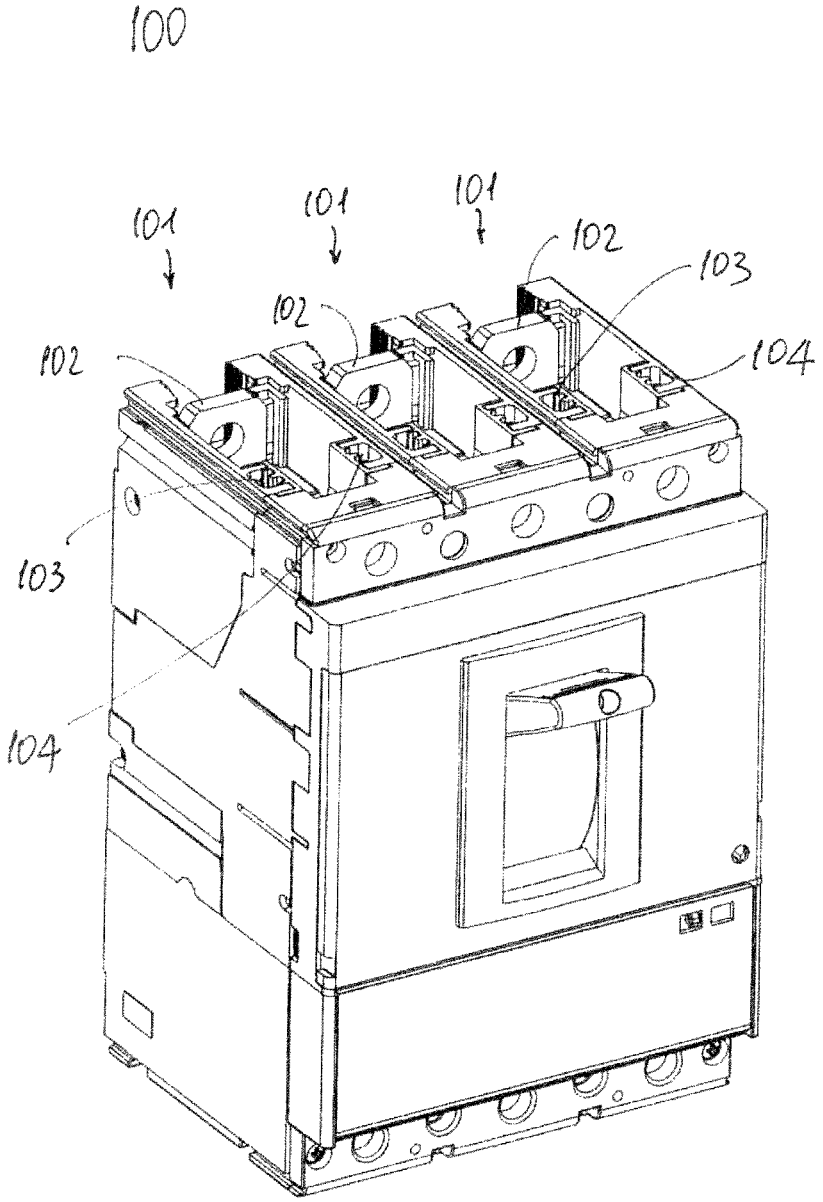

With reference to the accompanying figures, the terminal clamp cover device 1 according to the present model is adapted to be used in low voltage circuit breakers, in particular in a molded case circuit breaker 100 as represented in FIG. 1.

The circuit breaker 100 normally has one or more phases 101 (in this case three phases) each of which is provided with a terminal 102 for the electrical connection of said circuit breaker 100 to an electrical circuit. The circuit breaker is also provided, for each phase 101, with a clamp 2 for the connection of said terminal 102 to an electrical circuit and with one or more vent openings 103, 104 to discharge the gases produced in the arc chambers of said circuit breaker 100 during opening/closing operations.

In general, the operating principles, and the related components and mechanisms, of a low voltage circuit breaker used for the present model can be of conventional type and shall not be described in greater detail.

Figure 2A:
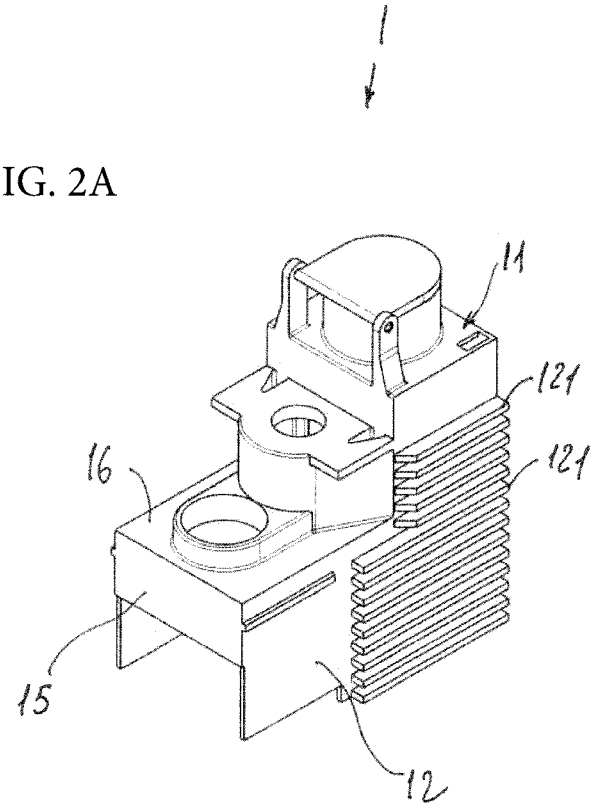
Figure 2B:
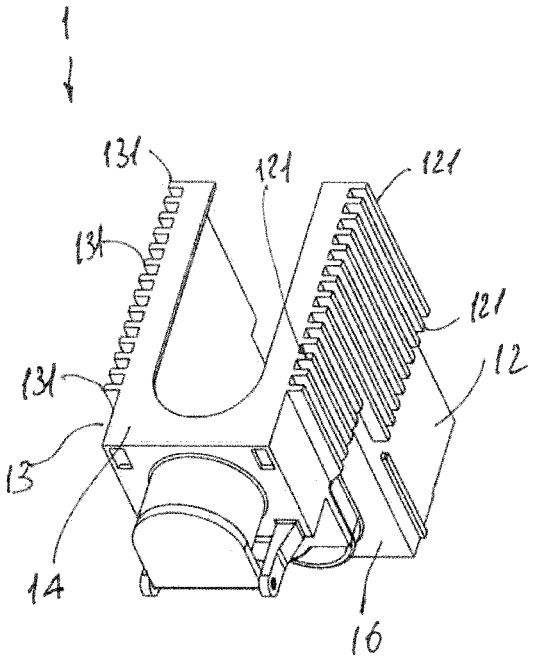
Figure 3:
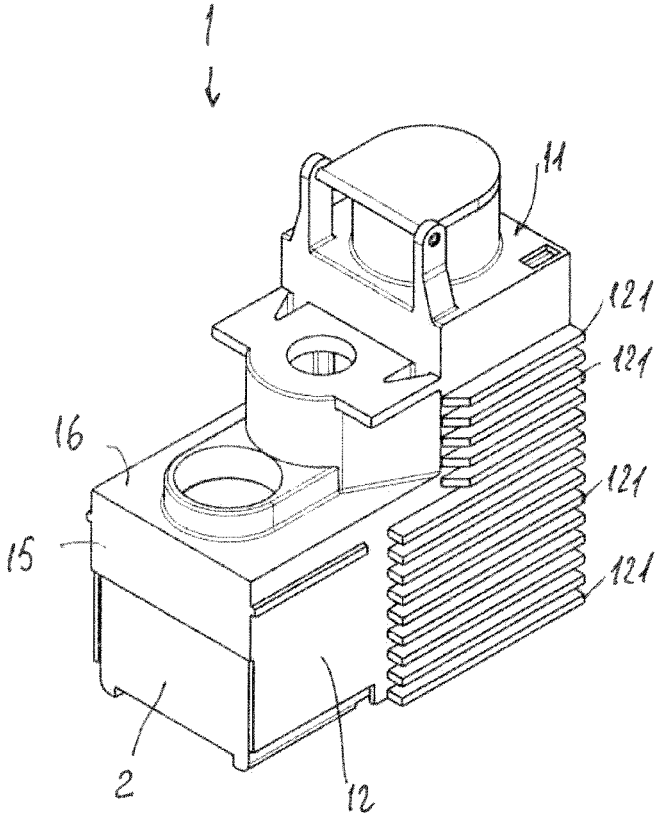
FIG. 3 represents a perspective view of an embodiment of a terminal clamp cover device for low voltage circuit breakers, according to the present model, installed over a corresponding clamp.

With particular reference to FIGS. 2*a*-*b* and 3, one of the peculiar features of the terminal clamp cover device 1 according to the present model is given by the fact of comprising an insulating body 11 that covers said clamp 2. In particular, the insulating body 11 is provided on at least one portion of its outer surface with a plurality of heat dissipating elements 121, 131.

Once again with reference to FIGS. 2*a*-*b* and 3, in a typical embodiment of the terminal clamp cover device 1 of the present model, the clamp 2 is substantially L-shaped and the insulating body 11 is also substantially L-shaped, so that its inner shape substantially mates with the outer shape of the clamp 2. In this way, the lateral portions of the clamps 2 that are facing a contiguous phase are completely insulated and shielded.

The insulating body 11 also has a first 12 and a second 13 substantially continuous and substantially L-shaped lateral surface, so as to cover the lateral walls of the clamp 2 substantially completely.

As shown in the accompanying figures, the plurality of heat dissipating elements 121, 131 is positioned on at least one portion of said first 12 and second 13 lateral surface.

In particular, in a greatly preferred embodiment of the terminal clamp cover device 1 represented in the accompanying figures, said plurality of heat dissipating elements 121, 131 advantageously consists of a plurality of parallel fins that are arranged along at least one portion of each of said first 12 and second 13 lateral surface of said insulating body 11.

For example, with reference to the accompanying figures, said parallel fins 121, 131 are positioned with a vertical trend, i.e., parallel to the outflow of heat from the circuit breaker in the upper portion of each of said first 12 and second 13 lateral surface of said insulating body 11.

Figure 5:
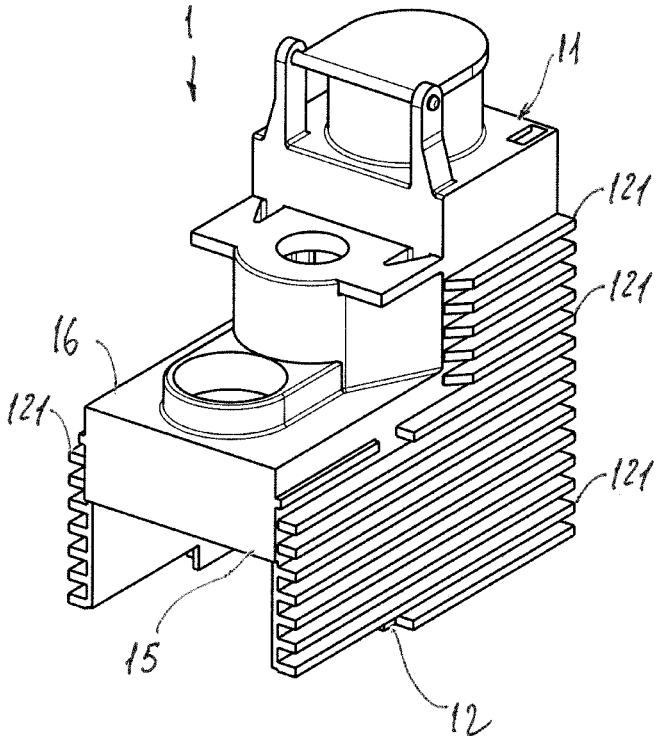
FIG. 5 represents a perspective view of a further embodiment of a terminal clamp cover device for low voltage circuit breakers according to the present model.

According to an alternative embodiment, illustrated in FIG. 5, said parallel fins 121, 131 are positioned substantially on the whole surface of each of said first 12 and second 13 lateral surface, with trend oriented in the direction of outflow of the gases.

Figure 4:
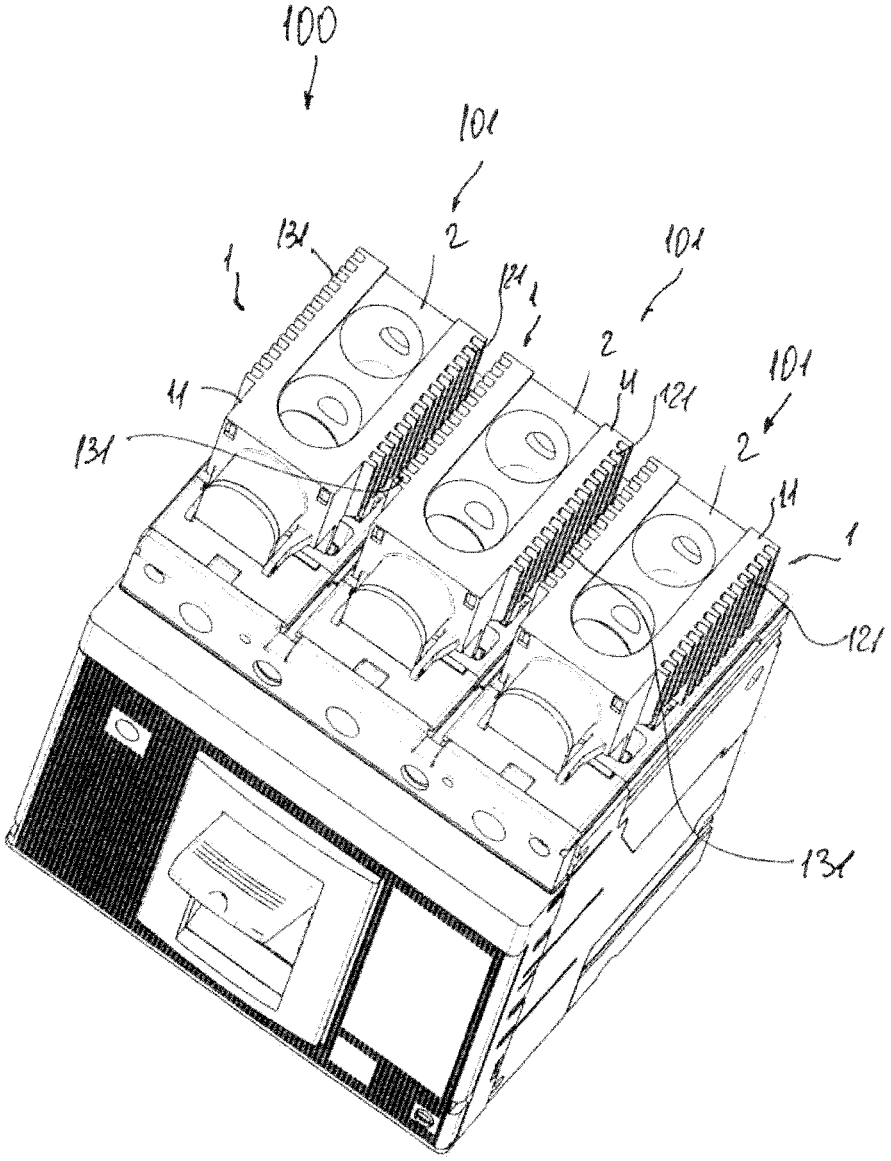
FIG. 4 represents a perspective view of an embodiment of a molded case circuit breaker in which a terminal clamp cover device according to the present model has been installed for each phase.

With reference also to FIGS. 1 and 4, in operating conditions (i.e., when clamp 2 and terminal clamp cover 1 are installed on the circuit breaker 100), at least one part of said parallel fins 121, 131 is positioned in proximity of the vents 103, 104 of the arc chambers of said circuit breaker 100. In this way, the gases exiting from the arc chamber of the circuit breaker 100 come immediately into contact with at least one part of the fins 121, 131 that contributed to cooling said gases and oblige them to follow an upward path out of the circuit breaker 100.

Moreover, the fins cool the clamps, and consequently increase the total thermal efficiency.

From the point of view of construction, at least one portion of said insulating body 11 and of said plurality of heat dissipating elements 121, 131 is made of plastic material, for example of thermoplastic materials possibly reinforced with fillers such as fiberglass and similar materials.

In practice, it is advantageous for at least one portion of said insulating body 11 and of said plurality of heat dissipating elements 121, 131 to be made of thermally conductive material so as to facilitate cooling of the terminals, and consequently improve the total thermal efficiency of the circuit breaker.

Once again with reference to FIGS. 2*a*-*b* and 3, the insulating body 11 of the terminal clamp cover device 1 advantageously has a rear surface and a lower surface 15 with openings that allow said clamp 2 to pass through. In this way, the first insulating body 11 of the terminal clamp cover 1 can be easily inserted by sliding on the corresponding clamp 2, and assembly of the clamp 2/terminal clamp cover 1 takes place in an extremely quick and easy manner.

Moreover, once again with reference to the aforesaid figures, the insulating body 11 of the terminal clamp cover 1 has an upper surface 14 and a front surface 16 that are advantageously provided with openings for access to said clamp 2 to fasten it to the corresponding terminal 102 of said circuit breaker 100 and to electrical connection means to said electrical circuit.

In practice, through the opening in the upper surface 14 of the insulating body 11 it is possible to insert cables (or similar connection means) for connection to the electrical circuit. Instead, through the opening in the front surface 16 it is possible, for example by means of screw means, to fasten the clamp 2 to the corresponding terminal 102 and block the connection cables in the seats of the clamp 2.

In this way, a circuit breaker 100 can be equipped with clamps 2 provided with respective terminal clamp covers 1, as illustrated in FIG. 4, in an extremely quick and easy manner.

As stated above, a low voltage circuit breaker 100, in particular a low voltage molded case circuit breaker, comprising one or more phases 101 each provided with a terminal 102 for the electrical connection of said circuit breaker, a clamp 2 for the connection of said terminal 102 to an electrical circuit and a vent opening 103, 104 to discharge the gases produced in the arc chambers of said circuit breaker during opening/closing operations, which comprises a terminal clamp cover device 1 as described herein, also form an aspect of the present model.

As has been seen from the description above and from the accompanying figures, the terminal clamp cover 1 for low voltage circuit breakers 100 according to the present model can be produced with relatively simple mechanical means, and therefore its production can take place with relatively limited costs.

Moreover, with the terminal clamp cover device 1 for low voltage circuit breakers 100 according to the present model it is possible to easily overcome the drawbacks present in the prior art circuit breakers, described above.

On the basis of the description given, other features, modifications or improvements are possible and evident to those with average skills in the art. These features, modifications and improvements must therefore be considered part of the present utility model. In practice, the materials used, the dimensions and contingent shapes may be any according to requirements and to the state of the art.

The invention claimed is:

1. A terminal clamp cover device for low voltage circuit breakers, having one or more phases each provided with a terminal for electrical connection of said circuit breaker, a clamp for the connection of said terminal to an electrical circuit, wherein said clamp is substantially L-shaped, and a vent opening to discharge gases produced in said circuit breaker during opening/closing operations, and an insulating body that covers said clamp, said insulating body being provided on at least one portion of its outer surface with a plurality of heat dissipating elements, wherein said insulating body is substantially L-shaped and has a first and a second substantially continuous and substantially L-shaped lateral surface, said plurality of heat dissipating elements being positioned on at least one portion of said first and second lateral surface.

2. The terminal clamp cover device for low voltage circuit breakers according to claim 1 wherein said plurality of heat dissipating elements comprises a plurality of parallel fins arranged along at least one portion of each of said first and second lateral surface.

3. The terminal clamp cover device for low voltage circuit breakers according to claim 2, wherein said parallel fins are positioned at least in an upper portion of each of said first and second lateral surface, with a trend oriented in a direction of outflow of the gases.

4. The terminal clamp cover device for low voltage circuit breakers according to claim 3, wherein said parallel fins are positioned substantially on a whole surface of each of said first and second lateral surface, with a trend oriented in the direction of outflow of the gases.

5. The terminal clamp cover device for low voltage circuit breakers according to claim 2, wherein at least one part of said parallel fins is adapted to be positioned in proximity of said vent opening of said circuit breaker.

6. The terminal clamp cover device for low voltage circuit breakers according to claim 1, wherein at least one portion of said plurality of heat dissipating elements is made of plastic material.

7. The terminal clamp cover device for low voltage circuit breakers according to claim 1, wherein at least one portion of said plurality of heat dissipating elements is made of electrically insulating and thermally conductive material.

8. The terminal clamp cover device for low voltage circuit breakers according to claim 1, wherein said insulating body has a rear surface and a lower surface provided with openings that allow passage of said clamp, and wherein said insulating body can be inserted by sliding on said clamp.

9. The terminal clamp cover device for low voltage circuit breakers according to claim 1, wherein said insulating body has an upper surface and a front surface provided with access openings to said clamp for fastening it to said terminal of said circuit breaker and to electrical connection means to said electrical circuit.

10. A low voltage circuit breaker, comprising the terminal clamp cover device according to claim 1.

11. The terminal clamp cover device for low voltage circuit breakers according to claim 2, wherein said parallel fins are positioned substantially on a whole surface of each of said first and second lateral surface, with a trend oriented in a direction of outflow of the gases.

12. The terminal clamp cover device for low voltage circuit breakers according to claim 3, wherein at least one portion of said plurality of heat dissipating elements is made of plastic material.

13. The terminal clamp cover device for low voltage circuit breakers according to claim 7, wherein at least one portion of said plurality of heat dissipating elements is made of electrically insulating and thermally conductive material.

14. The terminal clamp cover device for low voltage circuit breakers according to claim 7, wherein said insulating body has a rear surface and a lower surface provided with openings that allow passage of said clamp, and wherein said first insulating body can be inserted by sliding on said clamp.

15. The terminal clamp cover device for low voltage circuit breakers according to claim 1, wherein said insulating body has an upper surface and a front surface provided with access openings to said clamp for fastening it to said terminal of said circuit breaker and to electrical connection means to said electrical circuit.

16. The terminal clamp cover device for low voltage circuit breakers according to claim 7, wherein said insulating body has a rear surface and a lower surface provided with openings that allow passage of said clamp, and wherein said first insulating body can be inserted by sliding on said clamp.

17. The terminal clamp cover device for low voltage circuit breakers according to claim 16, wherein said insulating body has an upper surface and a front surface provided with access openings to said clamp for fastening it to said terminal of said circuit breaker and to electrical connection means to said electrical circuit.

18. The terminal clamp cover device for low voltage circuit breakers according to claim 2, wherein at least one portion of said plurality of heat dissipating elements is made of electrically insulating and thermally conductive material.

19. The terminal clamp cover device for low voltage circuit breakers according to claim 5, wherein at least one portion of said plurality of heat dissipating elements is made of plastic material.

* * * * *